US007128074B2

(12) United States Patent
MacNeil et al.

(10) Patent No.: US 7,128,074 B2
(45) **Date of Patent: *Oct. 31, 2006**

(54) SCARIFIER FOR THE INTERIOR SURFACE OF A PIPELINE

(75) Inventors: Gerard MacNeil, Surrey (CA); David MacNeil, Langley (CA); Gordon MacNeil, Delta (CA); Vernon Bose, Langley (CA)

(73) Assignee: Mac & Mac Hydrodemolition, Inc., Surrey (CA)

( * ) Notice: Subject to any disclaimer, the term of this patent is extended or adjusted under 35 U.S.C. 154(b) by 319 days.

This patent is subject to a terminal disclaimer.

(21) Appl. No.: 10/635,566

(22) Filed: Aug. 7, 2003

(65) Prior Publication Data

US 2004/0025912 A1 Feb. 12, 2004

Related U.S. Application Data

(60) Continuation-in-part of application No. 09/917,685, filed on Jul. 31, 2001, now Pat. No. 6,644,325, which is a continuation-in-part of application No. 09/569,880, filed on May 12, 2000, now Pat. No. 6,418,947, which is a division of application No. 09/126,113, filed on Jul. 30, 1998, now Pat. No. 6,206,016.

(51) Int. Cl.
*B08B 3/02* (2006.01)

(52) U.S. Cl. ..... 134/22.11; 134/22.12

(58) Field of Classification Search ..... 134/168 R, 134/169 R, 181, 22.11, 22.12; 451/76; 239/750, 239/264, 265

See application file for complete search history.

(56) References Cited

U.S. PATENT DOCUMENTS

| | | | | | |
|---|---|---|---|---|---|
| RE19,374 | E | * | 11/1934 | Butterworht | 134/167 R |
| 2,017,042 | A | | 10/1935 | Dougherty | |
| 2,089,597 | A | | 8/1937 | Carter | |
| 2,090,851 | A | | 8/1937 | Perkins | |
| 2,346,861 | A | * | 4/1944 | Montgomery | 451/51 |
| 2,358,557 | A | * | 9/1944 | Boyd et al. | 451/76 |
| 2,461,517 | A | | 2/1949 | Carnevale | |
| 2,951,319 | A | * | 9/1960 | Kornhaus | 451/76 |
| 3,016,201 | A | | 1/1962 | Brogden | |
| 3,074,649 | A | | 1/1963 | Atkinson | |
| 3,099,852 | A | | 8/1963 | Grant | |
| 3,106,491 | A | * | 10/1963 | Leibner | 118/685 |
| 3,109,262 | A | | 11/1963 | Weaver et al. | |
| 3,137,974 | A | * | 6/1964 | Kirkland | 451/102 |

(Continued)

FOREIGN PATENT DOCUMENTS

DE 2242062 2/1974

(Continued)

*Primary Examiner*—Frankie L. Stinson
(74) *Attorney, Agent, or Firm*—Hall, Vande Sande & Pequignot, LLP; Matthew A. Pequignot, Esq.

(57) ABSTRACT

An apparatus for scarifying an interior surface of a sewer pipe, which includes a vehicle moveable along an interior of the sewer pipe and a scarifying assembly connected to the vehicle having a fluid nozzle assembly. The fluid nozzle assembly has at least one branch with a fluid nozzle coupled to a distal end of the branch. The nozzle is positioned proximate the interior surface of the passageway. The fluid nozzle assembly is operative to rotate or oscillate and to emit a jet of fluid from the one nozzle against the interior surface of the passageway and to scarify the interior surface of the passageway as the vehicle moves along the passageway.

7 Claims, 10 Drawing Sheets

U.S. PATENT DOCUMENTS

| | | | | | |
|---|---|---|---|---|---|
| 3,153,510 | A | | 10/1964 | Brannfors et al. | |
| 3,230,668 | A | | 1/1966 | Stanley | |
| 3,434,174 | A | * | 3/1969 | Cerles et al. | 15/104.07 |
| 3,833,175 | A | | 9/1974 | Pulk et al. | |
| 3,883,175 | A | * | 5/1975 | Rodaway | 297/411.28 |
| 4,073,302 | A | | 2/1978 | Jones | |
| 4,161,956 | A | | 7/1979 | Hadgkiss | |
| 4,181,092 | A | * | 1/1980 | Johnson | 118/72 |
| 4,314,427 | A | | 2/1982 | Stoltz | |
| 4,603,661 | A | | 8/1986 | Nelson et al. | |
| 4,690,159 | A | | 9/1987 | Vadakin et al. | |
| 5,004,156 | A | | 4/1991 | Montanier | |
| 5,018,545 | A | | 5/1991 | Wells | |
| 5,020,188 | A | | 6/1991 | Walton | |
| 5,046,289 | A | | 9/1991 | Bengel et al. | |
| 5,052,423 | A | | 10/1991 | Chapman et al. | |
| 5,072,487 | A | | 12/1991 | Walton | |
| 5,081,800 | A | * | 1/1992 | Ruholl | 451/2 |
| 5,107,879 | A | * | 4/1992 | Harvey | 134/167 R |
| 5,113,885 | A | | 5/1992 | Ramsey | |
| 5,203,646 | A | * | 4/1993 | Landsberger et al. | 405/191 |
| 5,317,782 | A | | 6/1994 | Matsuura et al. | |
| 5,322,080 | A | | 6/1994 | Rankin | |
| 5,352,298 | A | | 10/1994 | Moulder | |
| 5,416,944 | A | * | 5/1995 | Eriksson | 15/104.09 |
| 5,518,553 | A | | 5/1996 | Moulder | |
| 5,520,734 | A | | 5/1996 | Taylor et al. | |
| 5,522,677 | A | | 6/1996 | Schlecht | |
| 5,561,883 | A | | 10/1996 | Landry et al. | |
| 5,851,580 | A | | 12/1998 | Amberg et al. | |

FOREIGN PATENT DOCUMENTS

| | | | | |
|---|---|---|---|---|
| EP | 0 365 921 | | | 5/1990 |
| FR | 2 499 880 | | | 8/1982 |
| GB | 2 149 051 | | * | 6/1985 |
| GB | 2252807 | | | 8/1992 |
| JP | 3089-986 | A | | 9/1989 |
| JP | 3089-987 | A | | 9/1989 |
| JP | 1-247583 | | * | 10/1989 |
| JP | 6-7754 | | | 1/1994 |
| JP | 6-126323 | | * | 5/1994 |
| JP | 6-229528 | | * | 8/1994 |
| SU | 379295 | | | 7/1973 |
| SU | 597441 | | | 2/1978 |
| SU | 749458 | | | 7/1980 |
| WO | WO 98-07532 | | | 2/1998 |

* cited by examiner

SCARIFIER FOR THE INTERIOR SURFACE OF A PIPELINE

RELATED APPLICATIONS

The present application is a continuation-in-part of U.S. patent application Ser. No. 09/917,685 file date Jul. 31, 2001 now U.S. Pat. No. 6,644,325, which is a continuation-in-part of U.S. patent application Ser. No. 09/569,880 file date May 12, 2001, now issued as U.S. Pat. No. 6,418,947, which is a division of application Ser. No. 09/126,113 filed on Jul. 30, 1998, now U.S. Pat. No. 6,206,016.

FIELD OF THE INVENTION

The present invention relates to a device for scarifying the interior surface of a pipe and more specifically for profiling the interior surface of a sewer pipe and for cleaning off any corrosion or contaminates from the surface thereof.

BACKGROUND OF THE INVENTION

Pipes used to carry liquids and gases commonly transport all types of materials including water, natural gas, solid and liquid sewage, as well as various other accumulations from the pipe. Currently, during initial installation, sewer pipes must be scarified first in order to provide a clean and profiled surface for the subsequent coating with such materials as polyvinyl chloride sheet. Older sewer pipes eventually need to be scarified to remove contamination, corrosion and loose material. The term "scarify" is intended to mean a removal of a layer or portion of the interior surface of the pipe whether or not it is contaminated or corroded in order to provide a profile to that surface. The term "profile" refers to a surface having peaks and valleys giving it a granulated texture similar to that of sandpaper. Such a surface provides a greater surface area so as to maximize bonding of the coating material. Profiled surfaces can range from fine-grained similar to the granularity of #150 Fine Sandpaper to a coarse-grained similar to the granularity of #60 Coarse Sandpaper.

The interior surface of a pipeline carrying solids, liquids and gases generally degrades over time as the pipe walls interact chemically and physically with the substances flowing through them. In particular, a sewer system's interior walls corrode and deteriorate because corrosive materials contaminate the surface degrading the metal and concrete used to build the sewer. The corrosive material arises from both the sewage and from the wastewater itself, and also from the digestive by-products of bacteria found in the sewage, which proliferate in the anaerobic environment. The corrosion causes the walls of the sewer pipe to physically decay, eventually reducing their overall thickness.

The principal source of corrosion is sulfuric acid, which arises as a product of the materials transported in a sewer pipe and the sewer environment itself. Various metal sulfates found in the sewage quickly convert into hydrogen sulfide by: reducing to sulfide ions in the waste water, combining with hydrogen in the water and out gassing above the liquid as hydrogen sulfide gas. Additional hydrogen sulfide originates from bacteria containing contaminants, which accumulate on the relatively rough concrete below the maximum liquid level. Bacteria found in these accumulations thrive in the anaerobic sewer environment producing hydrogen sulfide gas as a respiratory bi-product. Oxygen from the liquid below and oxygen condensing from the water in the air react with the hydrogen sulfide on the pipeline walls creating the highly corrosive sulfuric acid. The sulfuric acid attacks the calcium hydroxide in the concrete sewer walls leaving calcium sulfates, which ultimately crumble and fall off of the interior of the wall substantially reducing its thickness.

The waste water level in a sewer varies over the course of a 24-hour period. The flow is at its lowest level between 1:00 AM and 6:00 AM in the morning but it rises distinctly in the daytime and the pipe may operate near capacity. Because of the gaseous nature of the hydrogen sulfide, the pipe walls are predominately corroded in the portions of the wall above the minimum liquid level. Portions of the walls which are always below the water level are not subjected to such high concentrations of hydrogen sulfide gas or sulfuric acid and consequently do not experience the same levels of decay.

Eventually the sewer walls must be restored or they can suffer permanent damage leading to great expense. The restoration process is a two-step operation that consists of first cleaning all of the contaminants (and possibly outer layers of corrupted concrete) from the surface of the pipe and then applying a protective coating over the newly cleaned pipe surface. Attempting to apply a protective coating without first cleaning the pipe surface is futile because it does not stop the decay that has already begun underneath the coating. Furthermore, the protective coating itself does not adhere well to the contaminated surface. Thus, cleaning is an essential element of the restoration process. Even new sewer pipe must be scarified to provide a profiled surface and to remove the laitance and any dirt, oil or grease.

As previously mentioned, a sewer system typically operates at high capacity during the day with decreasing flow overnight. In order to restore the sewer pipes without diverting the flow (a costly and sometimes impossible alternative), a bulk of the work must be done at night during the brief period when the flow is at a minimum. As previously outlined, the restoration process involves both profiling the pipe surface and then applying a protective coat. In practice, the rate of restoration is impaired because manual scarifying (i.e., grinding) takes a proportionally greater amount of time than does the application of the protective coat. Consequently, a need exists for an automated scarifying process. Such a process will improve the rate of cleaning of the pipeline's interior walls making restoration without diversion a cost-effective possibility. Further, automation of the process can help to ensure that the same intensity of cleaning is applied to the entire surface without the quality variation that is inherent in manual execution.

SUMMARY OF THE INVENTION

According to the invention there is provided an apparatus for scarifying an interior surface of a sewer pipe, which includes a vehicle moveable along an interior of the pipe and a fluid nozzle assembly connected to the vehicle. The fluid nozzle assembly has at least one branch with a fluid nozzle coupled to a distal end of the branch. The nozzle is positioned proximate the interior surface of the pipe. The fluid nozzle assembly is operative to rotate or oscillate and to emit a jet of fluid from the nozzle against the interior surface of the passageway and to scarify the interior surface of the passageway as the vehicle moves along the sewer pipe.

The one branch may be extendible. Making the one branch replaceable with a branch of a different length may provide the extendibility. Alternatively, making the one branch in sections and adding or removing one or more sections may provide the extendibility of the one branch.

Preferably the one branch is coupled to an exchanger, which couples fluid to the one branch and rotates or oscillates.

Advantageously, the one branch has a counterweight coupled to the exchanger.

The counterweight may be a non-fluid conducting branch extending out from the exchanger on a side opposite to the one branch.

Preferably, there are a plurality of branches extending radially from said exchanger, said branches spaced so that each branch is counterbalanced by one or more other branches of the plurality of branches.

Advantageously, each branch of the plurality of branches is extendible and each branch has a fluid nozzle coupled to a distal end thereof.

Each branch of the plurality of branches is extendible by being replaceable with a branch of another length or alternatively by adding or removing sections of each branch.

The vehicle comprises a chassis operative to support the apparatus, the chassis being adjustable to accommodate various pipe sizes and having a track assembly operative upon rotation to propel the vehicle along a longitudinal direction in the interior of the pipe. A motor, mounted on the chassis and coupled to the track assembly, is operative to rotate the track assembly. A power coupler, mounted on the chassis and couplable to a power source, conducts power to the apparatus.

The vehicle may comprise a chassis, which may be adjustable to fit various pipe sizes and may support the apparatus, a track assembly which may propel the vehicle along a longitudinal direction of the pipe as it rotates. A motor mounted on the apparatus may drive the track assembly and a power coupler mounted on the chassis may conduct power to the apparatus. The power source may be any type of power, but preferably, the source may be electric or hydraulic. Advantageously, the power source may be located on-board the apparatus or may be at an off-board location remote from the vehicle.

Advantageously, the vehicle may be equipped with guiding bars affixed to the chassis at one end and having wall engaging attachments, which move along the interior surface of the pipe and maintain the orientation of the vehicle along a longitudinal axis of the pipe. Preferably the guiding bars are adjustable so as to extend from the vehicle to the interior surface of the pipe.

BRIEF DESCRIPTION OF THE DRAWINGS

The foregoing advantages and novel features of the invention will be more fully apparent from the following description when read in connection with the accompanying drawings in which.

DESCRIPTION OF THE PREFERRED EMBODIMENT

Embodiments of this invention are outlined below with reference to the drawings.

THE FIRST EMBODIMENT

Figure 1:
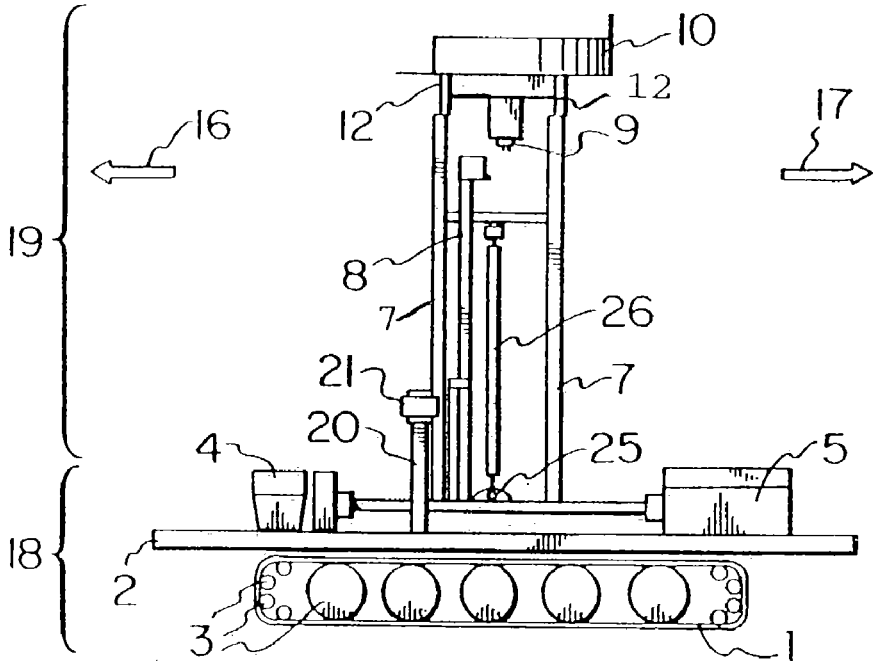
FIG. 1 is a side view of the first embodiment showing the vehicle and the scarifying system consisting of the arm and the fluid nozzle assembly.
Figure 2:
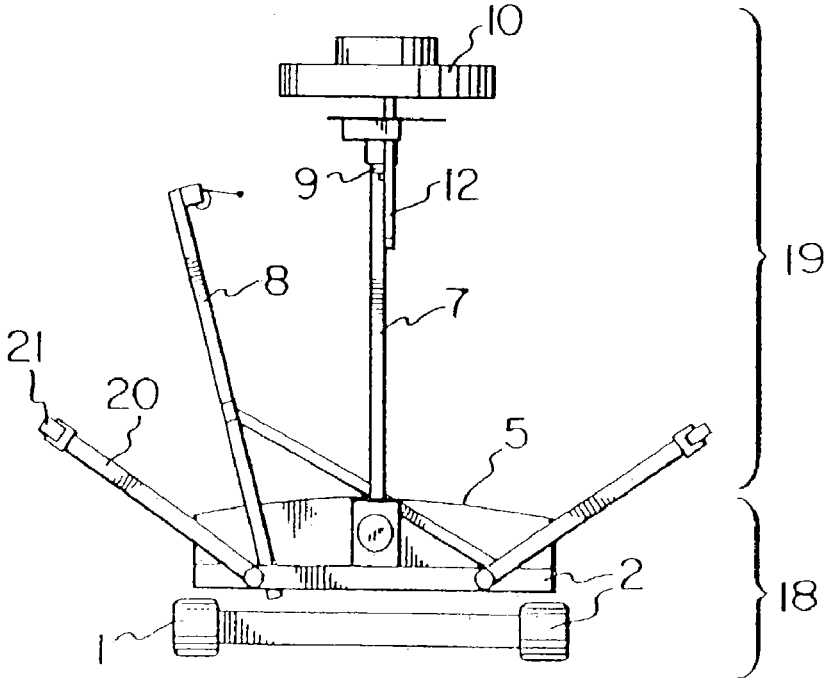
FIG. 2 is a front view of the first embodiment showing the arm in a vertical orientation.
Figure 3:
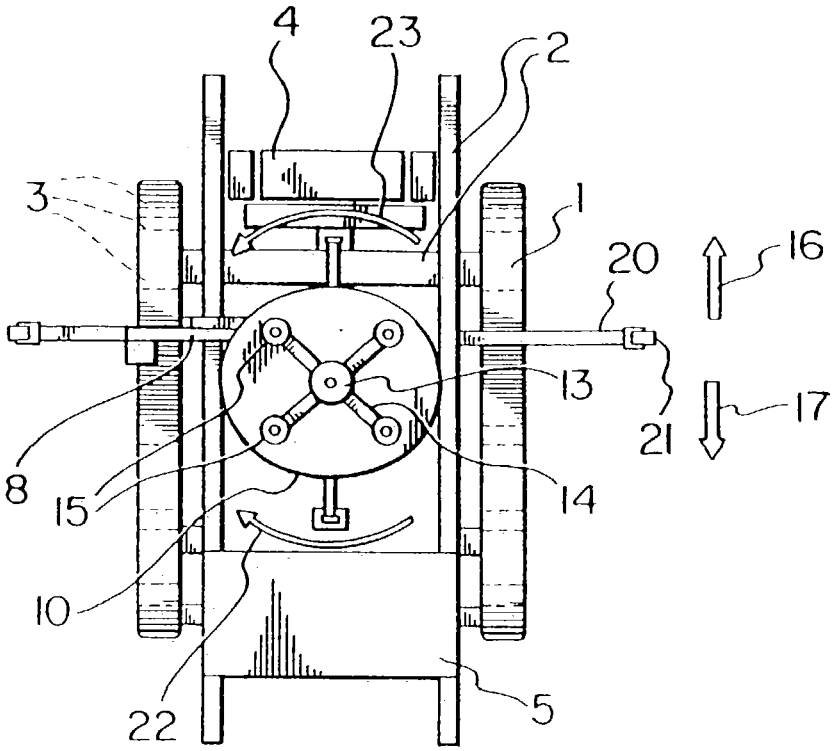
FIG. 3 is a top view of the first embodiment showing the principal arm in a vertical orientation.
Figure 4:
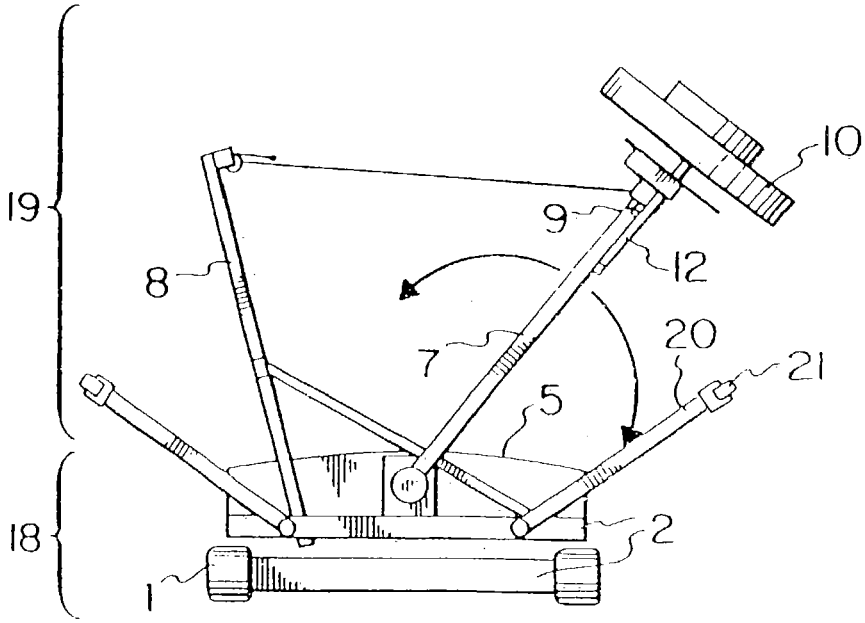
FIG. 4 is a front view of the first embodiment showing the arm extended at a radial angle to reach the interior surface of the pipe.
Figure 8:
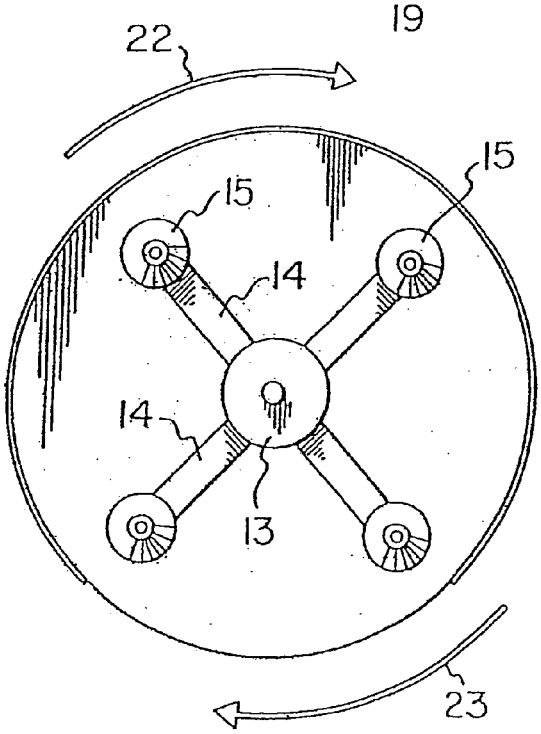
FIG. 8 is a top view of a nozzle assembly used in the scarifier.
Figure 9:
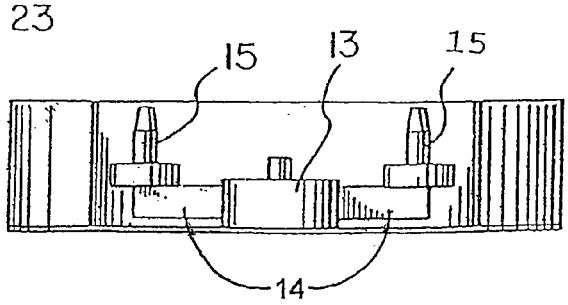
FIG. 9 is a side elevation view of the nozzle assembly used in the scarifier.

The first embodiment of the apparatus for scarifying the interior surface of a pipeline is depicted in FIGS. 1–4. FIGS. 1–3 depict side, front and top views, respectively, of the first embodiment with the arm 7 oriented in a vertical position. FIG. 4 depicts a front view of the apparatus with the arm 7 at a transverse angle. The nozzle assembly 10 of the first embodiment is depicted in FIGS. 8 and 9.

The apparatus comprises a vehicle 18 that is propelled along a longitudinal direction inside of a pipe, cleaning the interior surface as it travels. The apparatus is equipped with a scarifying system 19 comprising an arm 7 and a nozzle assembly 10. The scarifying system 19 extends from the vehicle to the wall of the conduit and uses nozzles to clean and scarify the interior surface of the pipe.

The vehicle 18 includes a chassis 2, which moves longitudinally along the bottom floor of the pipe on its track assembly 1. The tracks 1 are propelled along rollers 3 by a hydraulic motor (not shown) sitting on board the chassis 2. The hydraulic motor is powered by an external hydraulic reservoir (not shown) coupled to the apparatus by a hydraulic coupler (not shown) also mounted on the chassis 2. It will be noted that, although a hydraulic motor is used in this embodiment, any power providing means, both external or on-board but preferably exhaustless, may be used for this application. Alternatively, with a sufficiently light vehicle, the vehicle could also be moved manually. The direction of motion of the vehicle is that of arrow 16 or 17. An on-board battery 4 powers hydraulic switches (not shown), which control the speed and direction of motion of the vehicle. The motor, hydraulic coupler and hydraulic switches are covered with plate 5 to protect their sensitive parts from debris dislodged during cleaning. When nozzles 15 are employed to clean and/or scarify the walls of the conduit, recoil forces may tend to disturb the vehicle trajectory. Accordingly, a number of guiding bars 20 may be attached to the chassis 2 of the vehicle 18 and telescopically extend to the walls of the pipeline. The guiding bars' wall engaging attachments 21 move along the pipe's walls and prevent the vehicle 18 from deviating from its path.

The scarifying system 19 consists of a telescoping arm 7 and a fluid nozzle assembly 10. The arm 7 includes two telescoping pipes in which the upper portion of the pipe 12 has a smaller diameter such that it slides down into the lower portion. The piston 26 controls the extension of the telescoping arm 7. This combination of telescoping parts permits the arm 7 to be extended or contracted depending on the diameter of the pipe surface to be cleaned. The arm 7 pivots on hinge 25 in a lateral direction so that it can reach any transverse angle between 0° and 180°. Consequently, the device can manipulate the scarifying system 19 so that the fluid nozzle assembly 10 is in close proximity to the pipe walls. Since this embodiment contains only one arm 7, a stabilizing bar 8 is used to counteract the weight of the arm 7 as it is extended radially.

The scarifying system 19 may be easily removed from the chassis 2 of the vehicle 18 in order to reduce the size of the apparatus so as to enter a sewer system through a small aperture such as a manhole. Furthermore, the width of the chassis 2 (i.e. separation between tracks 1) can be adjusted so as to position the vehicle 18 longitudinally in pipes of various sizes.

The fluid nozzle assembly 10 is mounted at the distal end of the arm's 7 telescoping pipes. Fluid coupler 9 with a flow control valve is attached to an external source of fluid under pressure (not shown), which is fed into exchanger/actuator 13. Referring to FIG. 8, exchanger/actuator 13 causes the fluid nozzle assembly 10 to rotate or oscillate and distributes the fluid to each branch 14 of the fluid nozzle assembly 10. Arrows 22 and 23 indicate the direction of rotation. The actual fluid nozzles 15 emit jets of fluid aimed against the pipeline walls. The fluid nozzles 15 discharge fluid to profile and clean the interior surface of the pipe. The drawings show one fluid nozzle 15 attached to each branch 14, but it should be obvious to one skilled in the art that a plurality of nozzles 15 may be coupled to each branch 14.

Figure 13:
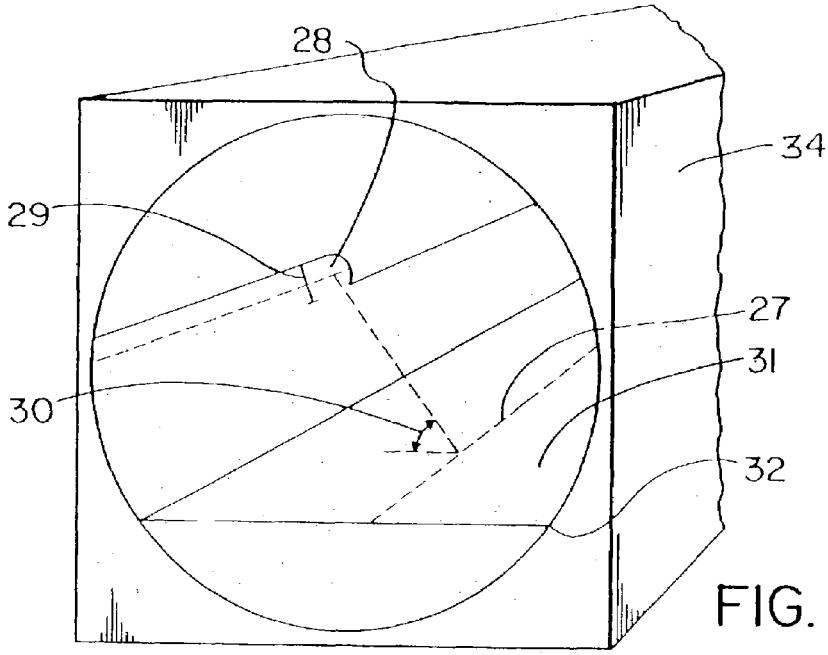
FIG. 13 depicts a swath of an interior surface of a pipe scarified by a first embodiment of the invention.

Referring now to FIGS. 4 and 13, as the vehicle 18 travels up the center of the pipe floor 27, the scarifying system 19 scarifies a swath of the pipe wall 28. The swath is approximately the same width 29 as the diameter of the fluid nozzle assembly 10 and is centered approximately at the arm angle 30. Fully scarifying the interior surface of the pipe requires that the vehicle 18 make several passes back and forth, changing the arm angle 30 with each pass. The vehicle chassis is outfitted with a drawbar (not shown), which holds the hydraulic and pressurized fluid tethers away from the apparatus so that it may easily travel forward or reverse without running over the tethers.

An additional safety feature not shown in the drawings is a "deadman" which is a safety switch operative to cut off the high pressure from the moving parts of the scarifying system 19. The deadman is useful in both emergency situations and when minor adjustments must be made to the apparatus during a job.

This apparatus is the preferred embodiment when the conduits or pipes are not perfectly cylindrical in shape (i.e. they are some other shape such as semicircular in cross section). This embodiment can also be used for a cylindrical pipe when flow diversion is impossible. A false floor 31 is layered on top of the minimum flow mark 32 and the cleaning is performed above the false floor 31. Since most of the corrosion occurs in levels above the minimum liquid level 32, this cleaning method is acceptable for restoration applications.

THE SECOND EMBODIMENT

Figure 5:
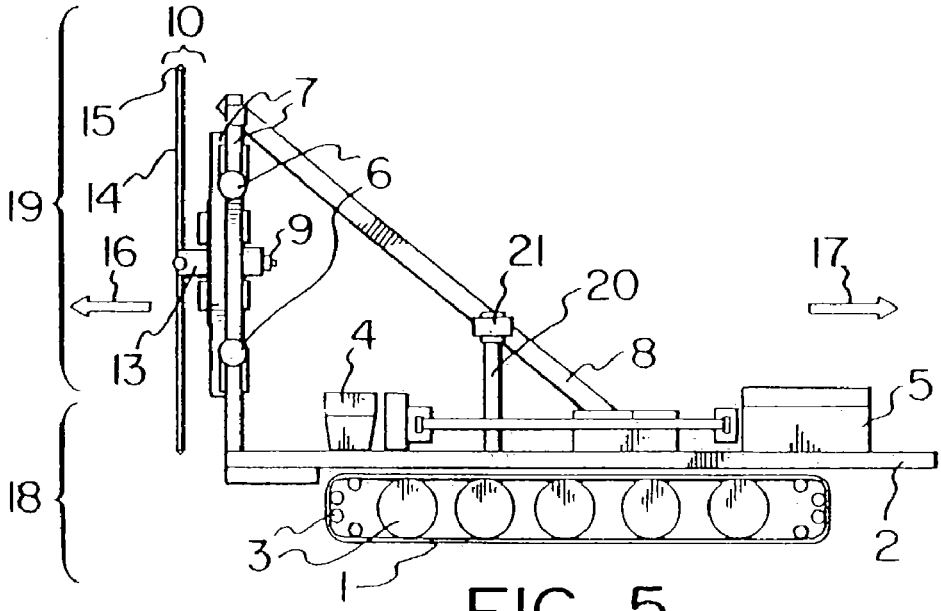
FIG. 5 is a side view of a second embodiment of the invention depicting an arm mounted vertically on the front of a vehicle and branches of a fluid nozzle assembly pointing radially at an interior surface of a pipe.
Figure 6:
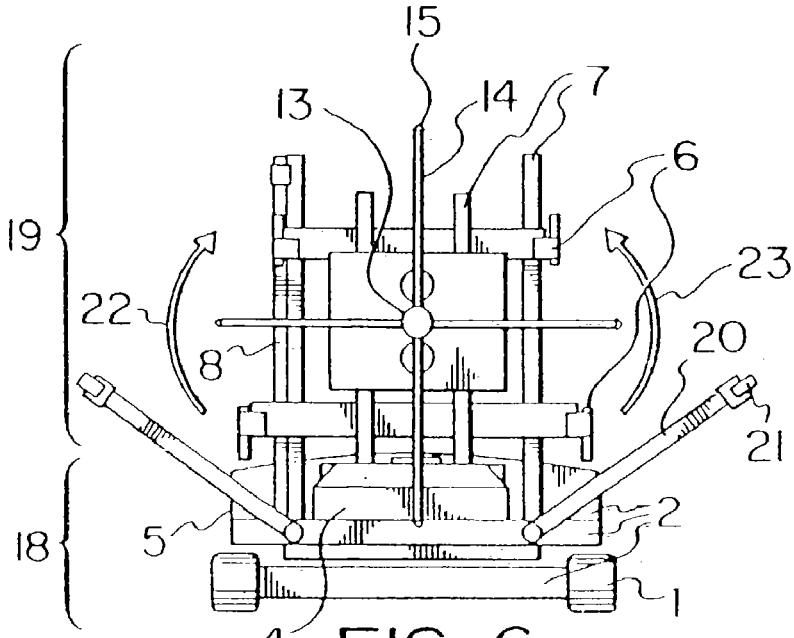
FIG. 6 is a front view of the second embodiment of FIG. 5.
Figure 7:
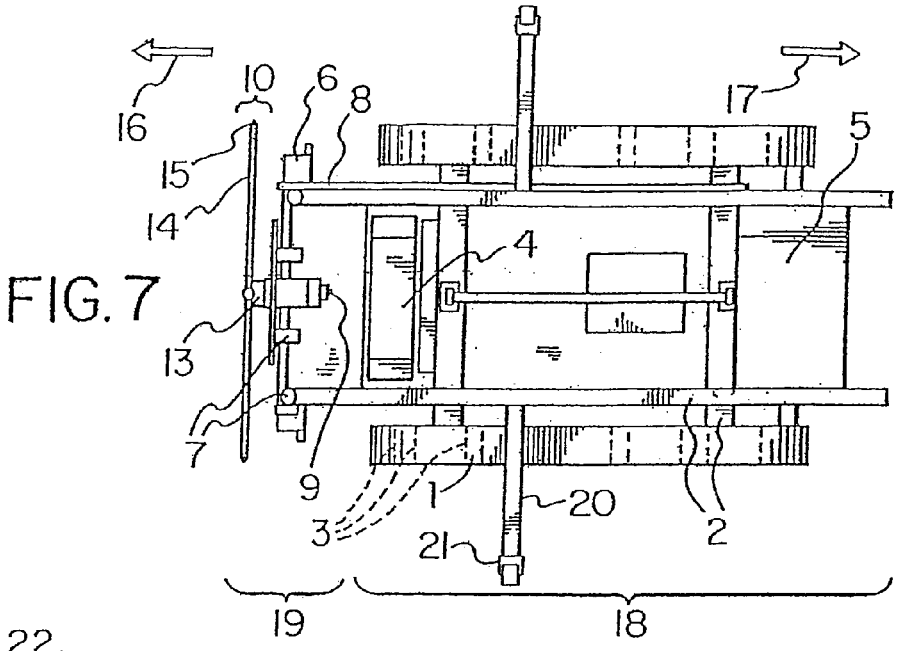
FIG. 7 is a top view of the second embodiment of the invention.

The second embodiment for scarifying the interior surface of a pipeline is depicted in FIGS. 5–7. The figures depict side, front and top views respectively of the second embodiment with the arm 7 mounted on the front of the vehicle.

As with the first embodiment, the apparatus comprises a vehicle 18 that propels itself along a longitudinal direction inside of a pipe, scarifying the interior surface as it travels. The apparatus is equipped with a scarifying system 19 including an arm 7 and a fluid nozzle assembly 10. The scarifying system 19 extends from the vehicle 18 to the wall of the conduit and uses fluid nozzles 15 to clean and/or profile the interior surface of the pipe.

The vehicle 18 is the same as the first embodiment and includes a chassis 2, which moves longitudinally along the bottom of the pipe floor on its track assembly 1. The tracks 1 are propelled along rollers 3 by a hydraulic motor (not shown) sitting on board the chassis 2. Although tracks 1 are included in this description of the preferred embodiment, any system capable of moving the vehicle 18 under power from the hydraulic motor will suffice. Alternatively, if the vehicle is made sufficiently light, it may be moved manually.

The hydraulic motor is powered by an external hydraulic reservoir (not shown) coupled to the apparatus by a hydraulic coupler (not shown) also mounted on the chassis 2. It will be noted that, although a hydraulic motor is used in this embodiment, that any power providing means, both external and on-board but preferably exhaustless, may be used for this application. The direction of motion of the vehicle 18 is that of arrow 16 or 17. An on-board battery 4 powers hydraulic switches (not shown), which control the speed and direction of motion of the vehicle. The motor, hydraulic coupler and hydraulic switches are covered with plate 5 to protect their sensitive parts from debris dislodged during cleaning.

When fluid nozzles 15 are employed to clean the walls of the conduit, recoil forces may tend to disturb the vehicle trajectory. Accordingly, a number of guiding bars 20 may be attached to the chassis 2 of the vehicle 18 and telescopically extend to the walls of the pipeline. The guiding bars' wall engaging attachments, 21 move along the pipe's walls and prevent the vehicle 18 from deviating from its path. Once again, the vehicle 18 may be adjusted in width by adjusting the chassis 2, so as to position the vehicle 18 longitudinally in pipes of various sizes. Similarly to the first embodiment, the vehicle chassis 2 is equipped with a drawbar (not shown) to hold the hydraulic and high pressure fluid tethers away from the vehicle 18.

In the second embodiment, the scarifying system 19 consists of a vertical arm 7 attached to the front of the chassis 2 and a fluid nozzle assembly 10. The entire scarifying system 19 may be easily removed from the chassis 2 of the vehicle 18 in order to reduce the size of the apparatus so as to enter a sewer system through a small aperture such as a manhole. In fact, the width of the tracks may be narrowed for the same reason and, after entering the sewer pipe, the tracks may be widened to a desired width. The arm 7 includes adjusters 6 which raise the fluid coupler 9 at the center of the fluid nozzle assembly 10 to align it roughly with the center of the pipe. This alignment permits even spray on all portions of the pipeline walls. The arm 7 has a stabilizing bar 8, which helps to counteract the weight of the arm 7 in front of the vehicle 18.

The fluid nozzle assembly 10 attaches to the vertical arm 7. Fluid coupler 9 with a flow control valve is attached to an external source of fluid under pressure (not shown). The fluid is fed into exchanger/actuator 13. Referring to FIG. 6, exchanger/actuator 13 causes the fluid nozzle assembly to rotate or oscillate and distributes the fluid to each branch 14 of the fluid nozzle assembly 10. The branches 14 are each counterbalanced by other branches of the plurality of branches. The direction of rotation of the fluid nozzle assembly 10 is indicated by arrows 22 and 23.

The branches 14 are laterally extendible so as to bring the fluid nozzles 15 (which are mounted on the ends of the branches 14) into proximity with the pipeline walls and direct them at the wall's interior surface. The meaning of the term "extendible" used here is intended to include any system by which the total length of the branches can be set so that the branches and nozzles at an end thereof are positioned proximate the interior wall of the sewer pipe. One type of extendibility of the branches is the replacement of branches with branches of a different length. Another scheme is providing branches, which can be telescopically lengthened. The apparatus can have only one branch 14, which is equipped with a nozzle and a counterweight to the one branch 14. The counterweight can be another branch 14 opposite the one branch or, obviously, it can be of any other shape as long as it counterbalances the branch 14. The counterbalance could even be made up of two or more counterbalancing elements symmetrically disposed with respect to an axis of the branch 14.

The fluid nozzles 15 discharge fluid to scarify the interior surface of the wall. Again it is understood as being obvious to one skilled in the art, that there may be a number of nozzles 15 for each branch 14. Alternatively, one could block off any number of nozzles by simply inserting plugs into the branches to be closed off. In addition, the fluid nozzles 15 can be angled with respect to their branches so that they provide a torque that causes them to rotate. In its simplest form one can have one nozzle at the end of a first branch and a second branch with its fluid channel blocked off extending out 180 ° C. to the first branch to act as a counterbalance to the first branch. Various other variants are possible and are obvious to an ordinary person skilled in the art.

As the vehicle 18 travels longitudinally along the center of the pipe floor in a direction indicated by arrows 16 and 17, the scarifying system 19 scarifies a transverse circumferential line along the interior of the pipe wall. Unlike the swaths in the first embodiment, this apparatus is capable of scarifying the entire interior surface in a single pass through the pipe. However, because a significantly larger area is being cleaned, the vehicle 18 must travel slower than it does in the first embodiment ensuring adequate coverage of the walls.

This apparatus is preferred over the first embodiment when the conduits or pipes are cylindrical in shape and the entire 360° circumference of the pipe is being cleaned.

THE THIRD EMBODIMENT

Figure 10:
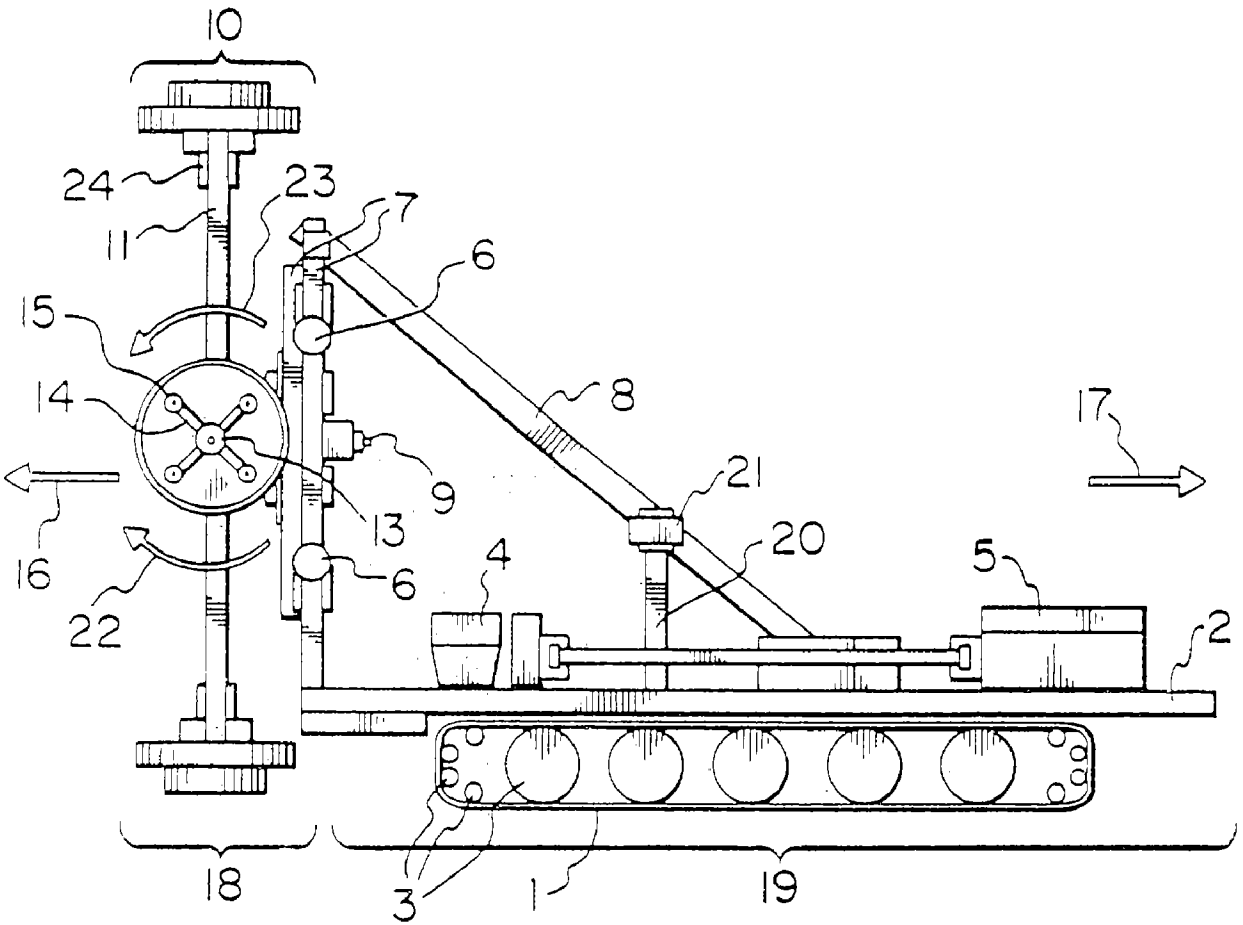
FIG. 10 is a side view of a third embodiment of the invention depicting a principal arm and subsidiary arms each having a fluid nozzle assembly.
Figure 11:
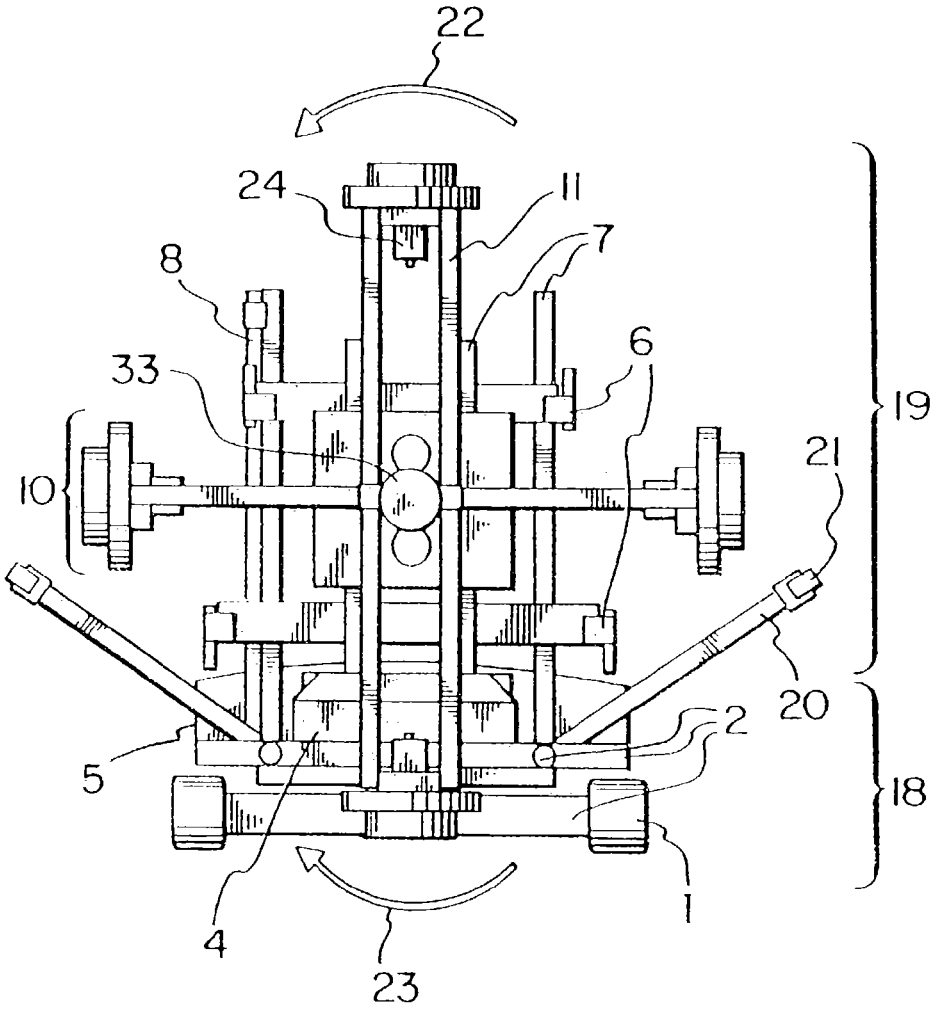
FIG. 11 is a front view of a third embodiment of the invention depicting a principal arm and subsidiary arms, each subsidiary arm having a fluid nozzle assembly.
Figure 12:
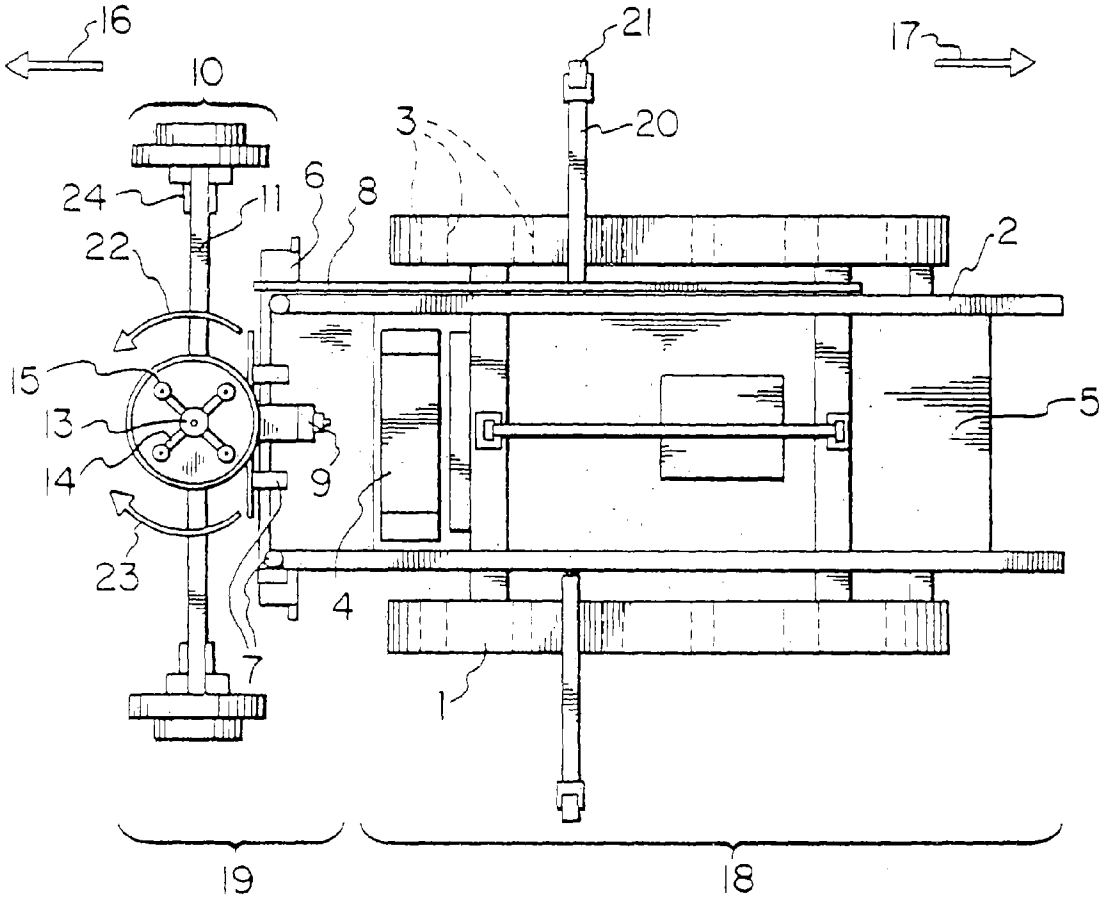
FIG. 12 is a top view of a third embodiment of the invention.

The third embodiment is a combination of the first and second embodiments and is depicted in FIGS. 10–12, which show side, front and top views, respectively. The principal arm 7 is connected to the front of the chassis 2 as in the second embodiment, but the spray nozzle assemblies 10 are that of the first.

The vehicle 18, chassis 2, motor (not shown), guiding bars 20, guiding bar attachments 21, battery 4, hydraulic coupler, deadman and drawbar (not shown) are substantially the same as that of the first two embodiments. The cleaning system 19, however, is considerably different. The principal arm 7 is oriented vertically and is essentially the same as the arm in the second embodiment, but it has a plurality of additional subsidiary arms 11 which extend transversely from the center of the principal arm 7. The adjusters 6 move vertically to align the center of the subsidiary arms 11 with the center of the pipe. The subsidiary arms 11 are telescopically adjustable so that they can extend transversely to the inner surface of the pipeline walls. A fluid coupler 9 with flow control valve receives fluid under pressure from an external source (not shown). An exchanger/actuator 33 simultaneously rotates or oscillates the subsidiary arms 11 and distributes the fluid. At the end of each subsidiary arm 11 is a nozzle assembly 10 that is basically the same as that of the first embodiment. Each nozzle assembly 10 has a secondary fluid coupler 24, an exchanger/actuator 13, symmetrical branches 14, and spray nozzles 15.

The vehicle 18 travels longitudinally along the center of the pipe in a direction indicated by arrows 16 or 17, while the subsidiary arms 11 rotate or oscillate in the direction of arrow 22 or 23, moving the spray nozzle assemblies 10 laterally across the inner circumference of the pipeline wall. The spray nozzle assemblies 10 are simultaneously rotating or oscillating such that they are cleaning a swath similar to the first embodiment, but the swath is laterally oriented.

The third embodiment (like the second) is most useful for cleaning the entire circumference of the interior of a cylindrical pipe. However, the wide swath enabled by incorporating the nozzle assembly 10 from the first embodiment permits the vehicle 18 to travel faster down the pipeline floor and still maintain adequate coverage of the walls.

THE FOURTH EMBODIMENT

Figure 14:
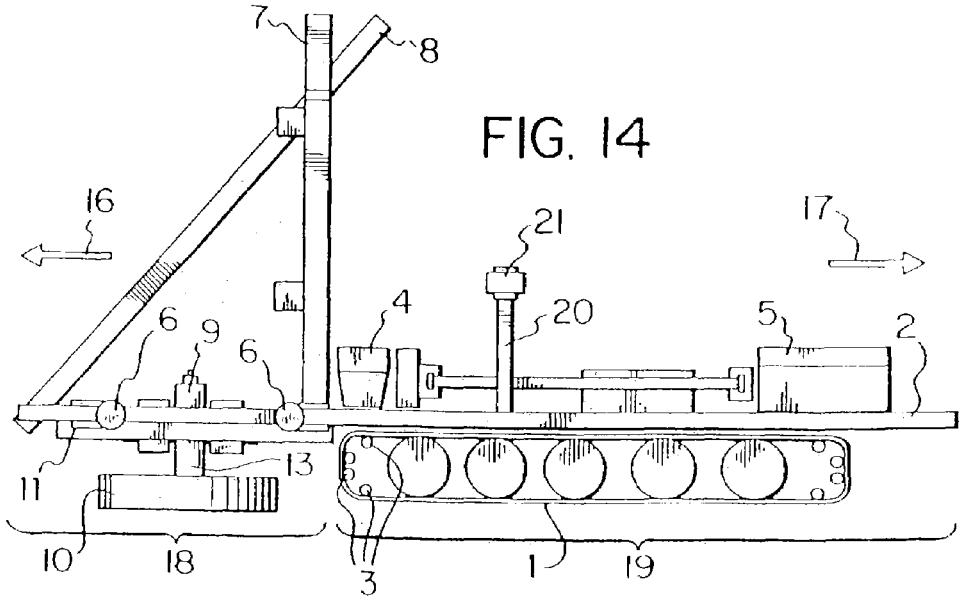
FIG. 14 is a side view of a fourth embodiment of the invention employed for scarifying a bottom surface of a pipe.
Figure 15:
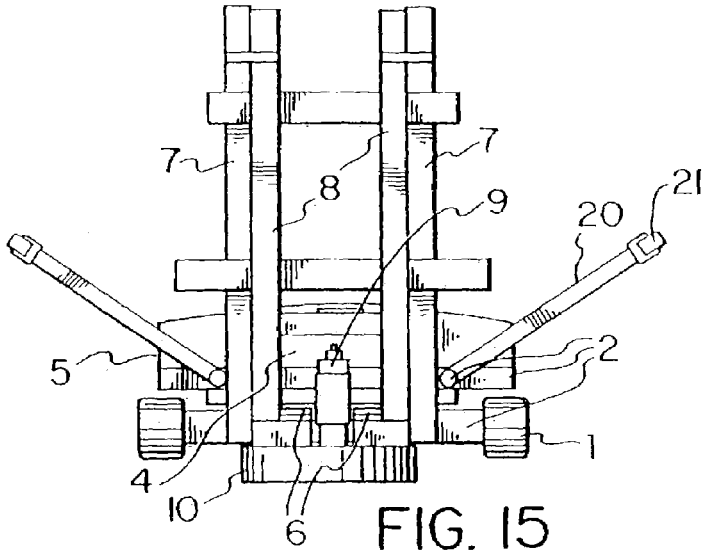
FIG. 15 is a front view of the fourth embodiment fo the invention.
Figure 16:
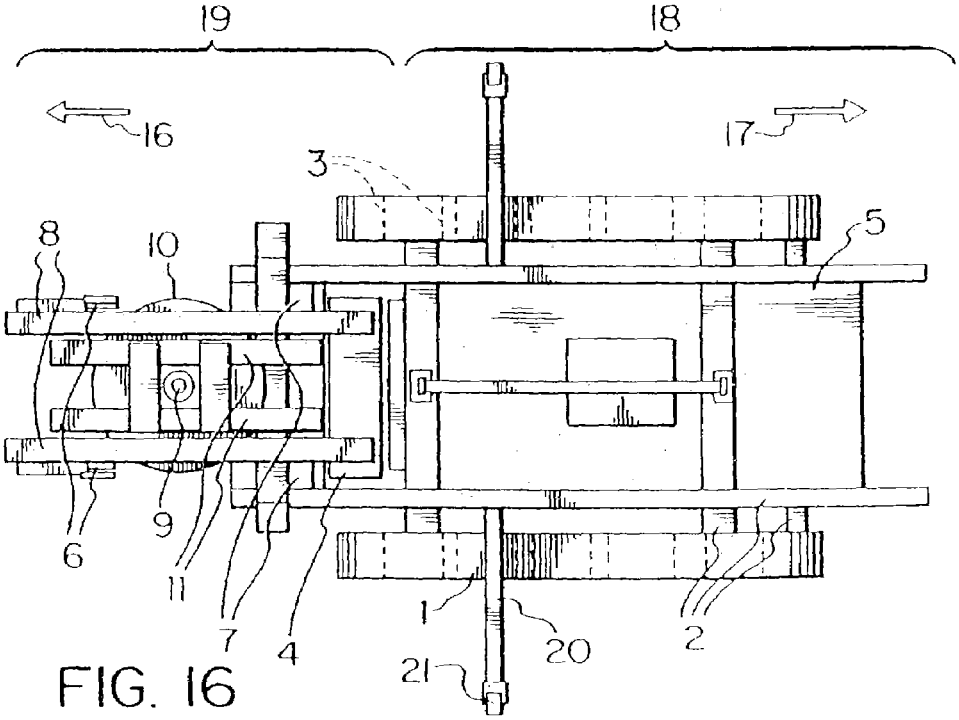
FIG. 16 is a top view of the fourth embodiment of the invention.

The fourth embodiment is also a combination of the first and second embodiments, which is particularly adapted to clean the bottom surfaces of pipelines. The fourth embodiment is depicted in FIGS. 14–16, which show side, front and top views respectively. The principal arm 7 is connected to the front of the chassis 2 as in the second embodiment but the nozzle assembly 10 is that of the first.

The vehicle 18, chassis 2, motor (not shown), guiding bars 20, guiding bar attachments 21, battery 4, hydraulic coupler, deadman and drawbar (not shown) are substantially the same as those of the first two embodiments. The scarifying system 19, however, is considerably different. The principal arm 7 is oriented vertically and is essentially the same as the arm in the second embodiment, but it has an additional subsidiary arm 11, which extends forwardly from the principal arm 7. The adjusters 6 move vertically up the principal arm 7 to adjust the height of the subsidiary arm 11. The subsidiary arm 11 holds the fluid nozzle assembly 10, and the fluid coupler 9 with flow control valve which are basically the same elements as in the first embodiment. The fluid nozzle assembly 10 is outfitted with an exchanger actuator 13, symmetrical branches 14, and fluid nozzles 15. Note: these elements are shown in FIGS. 8 and 9. A stabilizing bar 8 extends from the front end of the subsidiary arm 11 to the top end of the principal arm 7 to help stabilize the front of the apparatus when it is carrying the additional weight of the fluid nozzle assembly 10.

The vehicle 18 travels longitudinally along the center of the pipe in a direction indicated by arrows 16 or 17, while the branches 14 of the nozzle assembly 10 rotate or oscillate, moving the spray nozzles 15 around on the bottom surface of the pipeline. The spray nozzles cut a swath similar to the first embodiment except that the swath is on the bottom surface of the pipe rather than at a radial angle. The fourth embodiment is specifically suited for cleaning the bottom surface of a pipeline.

Figure 17:
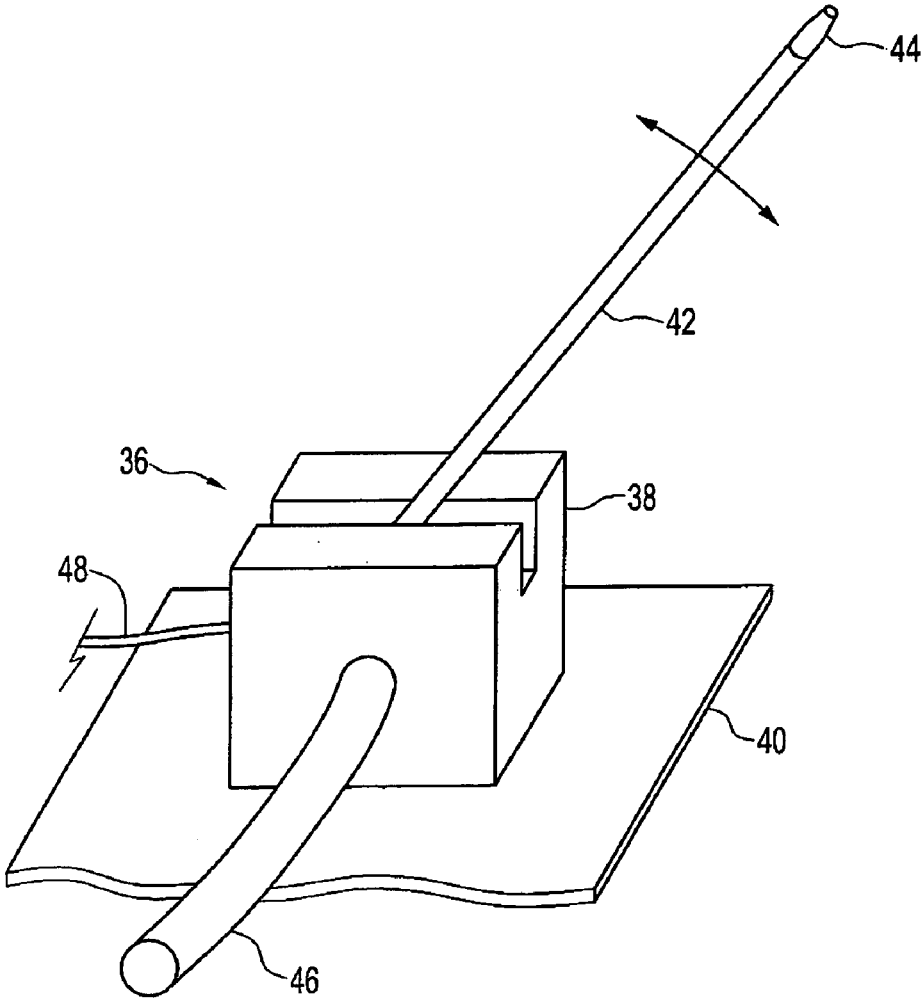
FIG. 17 is a perspective view of an alternative embodiment of the nozzle assembly.

Referring to FIG. 17, the nozzle assembly 36 comprises a single oscillating arm or branch 42 having a nozzle 44 at a distal end and coupled at another end to a motor assembly (not shown) contained within a chassis 38. A high pressure water hose 46 couples to the branch within the chassis 38 and an electrical cable 48 couples to the motor assembly (not shown). The chassis 38 is mounted on a moveable vehicle 40 that carries it along an interior of a pipe. The length of the arm or branch 42 is selected so that the nozzle 44 is proximate an interior surface of the pipe to be scarified.

In operation, the vehicle 40 is indexed from one position to the next and at each position the arm makes a complete sweep from one side to the next. In order to cover a wider area, the nozzle 44 could be made to rotate about an axis at an angle to its own axis. Alternatively, a nozzle assembly with one or more nozzles rotating about an axis through the arm 42 could be employed. In order to cover a maximum of pipe wall area, the chassis 38 has to be mounted as close to the bottom of the pipe as possible.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. Method for scarifying an interior surface of a sewer pipe, comprising:

(a) providing a vehicle moveable along an interior of said pipe, said vehicle having a fluid nozzle assembly mounted to an oscillating mechanism and coupled to an external source of fluid, said fluid nozzle assembly having at least one branch and a fluid nozzle coupled to a distal end of said one branch, said fluid nozzle positionable proximate the interior surface of said pipe, said fluid nozzle assembly being operative to emit a jet of fluid from said fluid nozzle against the interior surface of said sewer pipe and to scarify the interior surface of said pipe;

(b) positioning said fluid nozzle proximate the interior surface of said sewer pipe;

(c) emit jets of fluid from said fluid nozzles against the interior surface of said sewer pipe;

(d) scarifying a swath of the interior surface of said sewer pipe by sweeping said fluid nozzle about an axis substantially parallel to a longitudinal axis of said sewer pipe from a first side of said sewer pipe to a second side of said sewer pipe;

(e) moving said vehicle forward along said longitudinal axis of said sewer pipe a predetermined distance equal to or less than a width of said swath; and (f) scarifying a swath of the interior surface of said sewer pipe by sweeping said fluid nozzle about an axis substantially parallel to said longitudinal axis of said sewer pipe from said second side of said sewer pipe to said first side of said sewer pipe.

2. The method according to claim 1, wherein said one branch is extendible.

3. The method according to claim 2, wherein the extendibility of said one branch is provided by making said one branch replaceable with a branch of a different length.

4. The method according to claim 2, wherein the extendibility of said one branch is provided by making said one branch in sections and adding or removing one or more sections.

5. A method according to claim 1, wherein said vehicle has:

(a) a chassis operative to support said fluid nozzle assembly, said chassis being adjustable to accommodate various pipe sizes and having a track assembly operative upon rotation to propel said vehicle along said pipe;

(b) a motor mounted on said chassis and coupled to said track assembly, said motor operative to rotate said track assembly; and (c) a power coupler mounted on said chassis and couplable to a power source, said power coupler operative to conduct power from said power source.

6. A method according to claim 5, wherein said power coupler is couplable to one of a pressurized source of hydraulic fluid and an electric power source.

7. A method according to claim 1, wherein said vehicle has a chassis operative to support said apparatus, said chassis being adjustable to accommodate various pipe sizes and having a track assembly operative upon rotation to propel said vehicle along a longitudinal direction in the interior of said pipe;

said vehicle being passive and moveable by an external driving force, said driving force being one of mechanical and human powered.

* * * * *

UNITED STATES PATENT AND TRADEMARK OFFICE

CERTIFICATE OF CORRECTION

PATENT NO. : 7,128,074 B2
APPLICATION NO. : 10/635566
DATED : October 31, 2006
INVENTOR(S) : Gerard MacNeil et al.

It is certified that error appears in the above-identified patent and that said Letters Patent is hereby corrected as shown below:

On the Title Page, Item (73)
"Mac & Mac Hydrodemolition, Inc." should be -- Mac & Mac Hydrodemolition Inc. --.

Column 8, Line 53:

"forwardly" should be -- horizontally --.

Signed and Sealed this

Twenty-eighth Day of August, 2007

JON W. DUDAS
*Director of the United States Patent and Trademark Office*